US007188726B2

(12) United States Patent
Lin

(10) Patent No.: US 7,188,726 B2
(45) Date of Patent: Mar. 13, 2007

(54) TOOLBOX WITH PIVOTAL INNER TOOL HOLDERS

(76) Inventor: Hung-Lin Lin, No. 581-6, Changhsing Rd., Sec. 2, Changhua City (TW)

( * ) Notice: Subject to any disclaimer, the term of this patent is extended or adjusted under 35 U.S.C. 154(b) by 179 days.

(21) Appl. No.: 11/076,977

(22) Filed: Mar. 11, 2005

(65) Prior Publication Data

US 2006/0201837 A1 Sep. 14, 2006

(51) Int. Cl.

| | |
|---|---|
| ***B65D 85/20*** | (2006.01) |
| ***B65D 5/50*** | (2006.01) |
| ***B65D 43/16*** | (2006.01) |
| ***B65D 51/04*** | (2006.01) |
| ***A47F 7/00*** | (2006.01) |

(52) U.S. Cl. ..... 206/373; 206/379; 206/743; 206/747; 206/755; 211/69; 211/70.6; 220/832; 220/843

(58) Field of Classification Search ..... 206/373, 206/379, 743–749, 751, 754–755; 220/831–832, 220/843–844; 211/69, 70.6
See application file for complete search history.

(56) References Cited

U.S. PATENT DOCUMENTS

| | | | | |
|---|---|---|---|---|
| 3,074,539 | A * | 1/1963 | Rogovin | 206/379 |
| 4,598,824 | A * | 7/1986 | Long et al. | 220/831 |
| 6,105,770 | A * | 8/2000 | Vasudeva | 206/378 |
| 6,547,074 | B1 * | 4/2003 | Chen | 206/379 |
| RE38,905 | E * | 12/2005 | Wei | 206/373 |
| 7,021,464 | B2 * | 4/2006 | Chen | 206/379 |
| 7,032,750 | B2 * | 4/2006 | Amtenbrink | 206/379 |

* cited by examiner

*Primary Examiner*—Bryon P. Gehman
(74) *Attorney, Agent, or Firm*—Rosenberg, Klein & Lee

(57) ABSTRACT

A toolbox is disclosed to include a box body, a top cover pivoted to the box body, a plurality of tool holders respectively pivoted to the box body and linked to one another, and an actuating arm coupled between the box body and one tool holder in such a manner that the tool holders are turned out of the box body for arrangement of storage tool members when opening the top cover, or turned into the inside of the box body when closing the top cover.

1 Claim, 5 Drawing Sheets

TOOLBOX WITH PIVOTAL INNER TOOL HOLDERS

BACKGROUND OF THE INVENTION

1. Field of the Invention

The present invention relates to a toolbox and more particularly, to such a toolbox which have tool holders be turned out of the box body when the user opens the top cover, or received inside the box body when the user closes the top cover.

2. Description of the Related Art

Various toolboxes are commercially available for keeping tool members. These toolboxes commonly have a box body, which defines a plurality of compartments or receiving holes for receiving tool members, and a top cover hinged to the box body for closing the box body. Because the compartments or receiving holes are fixedly provided inside the box body, it is inconvenient to load or arrange storage tool members.

SUMMARY OF THE INVENTION

The present invention has been accomplished under the circumstances in view. According to one aspect of the present invention, the toolbox comprises a box body, a plurality of tool holders pivotally mounted inside the box body and turnable in and out of the box body for easy loading/unloading of tool members, and a top cover pivotally coupled to the box body for closing/opening the box body. According to another aspect of the present invention, links are symmetrically provided at two sides and respectively connected between each two adjacent tool holders, and an actuating arm is coupled to the top cover between the box body and one side of one of the tool holders in such a manner that the tool holders are turned out of the box body when the user opens the top cover, or received inside the box body when the user closes the top cover.

DETAILED DESCRIPTION OF THE PREFERRED EMBODIMENT

Figure 1:
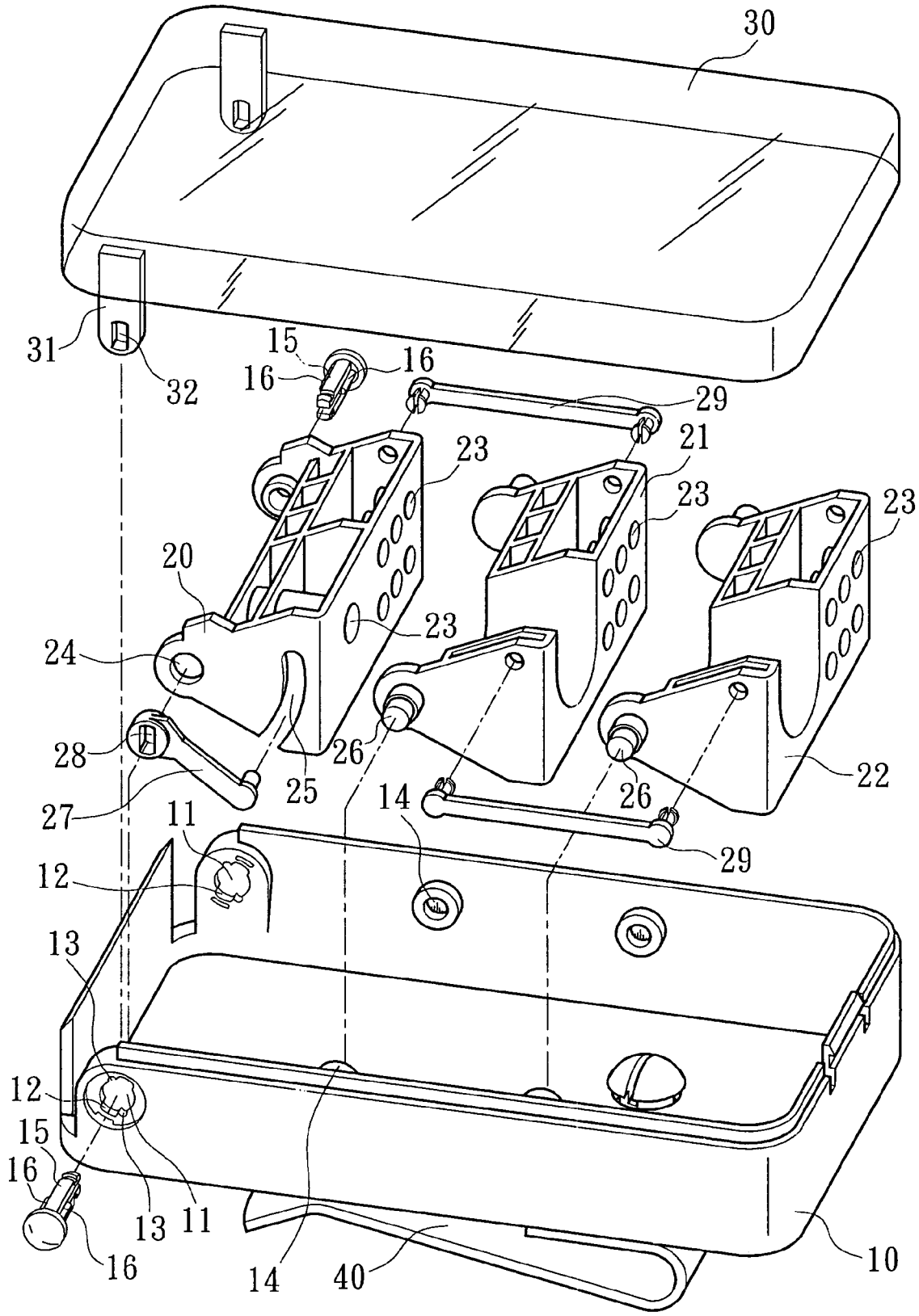
FIG. 1 is an exploded view of a toolbox according to the present invention.

Referring to FIGS. 1~4, a toolbox in accordance with the present invention is shown comprised of a box body 10, a top cover 30, and a plurality of tool holders 20, 21, 22.

The box body 10 comprises two pivot holes 11 formed in the two opposite sidewalls thereof near one end, two first locating notches 12 respectively formed in each of the two opposite sidewalls in communication with the pivot holes 11, two second locating notches 13 respectively formed in each of the two opposite sidewalls in communication with the pivot holes 11 and respectively spaced from the respective first locating notches 12 at an angle, a plurality of pivot holders 14 symmetrically disposed at the two opposite sidewalls on the inside and respectively aligned in a line at each sidewall, and a clip 40 at the bottom side thereof.

The top cover 30 comprises two lugs 31 symmetrically disposed at two opposite lateral sides near one end. Each lug 31 having a sliding slot 32.

The tool holders 20, 21, 22 each comprise a plurality of plugholes 23 for holding tools or tool members. The first tool holder 20 comprises two pivot holes 24 respectively disposed at the two opposite lateral sides thereof near the front side and respectively pivotally connected to the pivot holes 11 of the box body 10 and the sliding slots 32 of the lugs 31 of the top cover 30 by a respective pivot bolt 15. The pivot bolt 15 has two locating ribs 16 symmetrically protruded from the periphery at two sides for selectively engaging into the first locating notches 12 or second locating notches 13. An actuating arm 27 is provided having a sliding slot 28 disposed at one end and coupled to one pivot bolt 15 between one pivot hole 11 of the box body 10 and one pivot hole 24 of the first tool holder 20. The other end of the actuating arm 27 is an angled end coupled to a smoothly arched sliding slot 25 at one lateral side of the first tool holder 20. The other tool holders 21, 22 each have two pivot rods 26 respectively disposed at the two opposite lateral sides thereof near the front side and respectively pivotally connected to a respective pivot holder 14 at each of the two opposite sidewalls of the box body 10. Further links 29 are alternatively disposed at two sides and respectively connected between each two adjacent tool holders 20~22 to link the tool holders 20~22 so that the tool holders 20~22 can be turned about a respective axis in and out of the box body 10.

Figure 2:
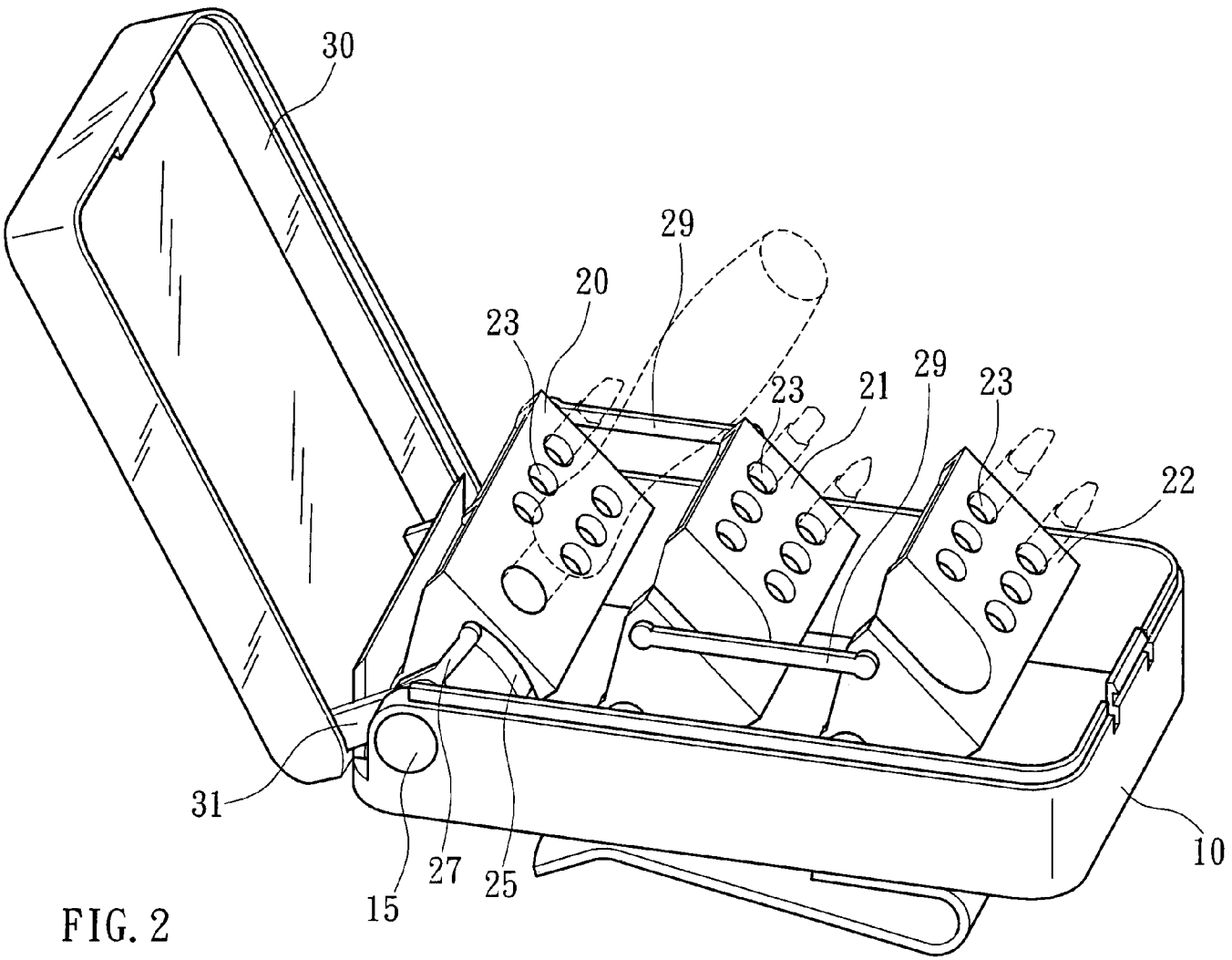
FIG. 2 is a schematic drawing showing the toolbox opened and storage tool members held in the plugholes of the tool holders according to the present invention.
Figures 3, 3A:
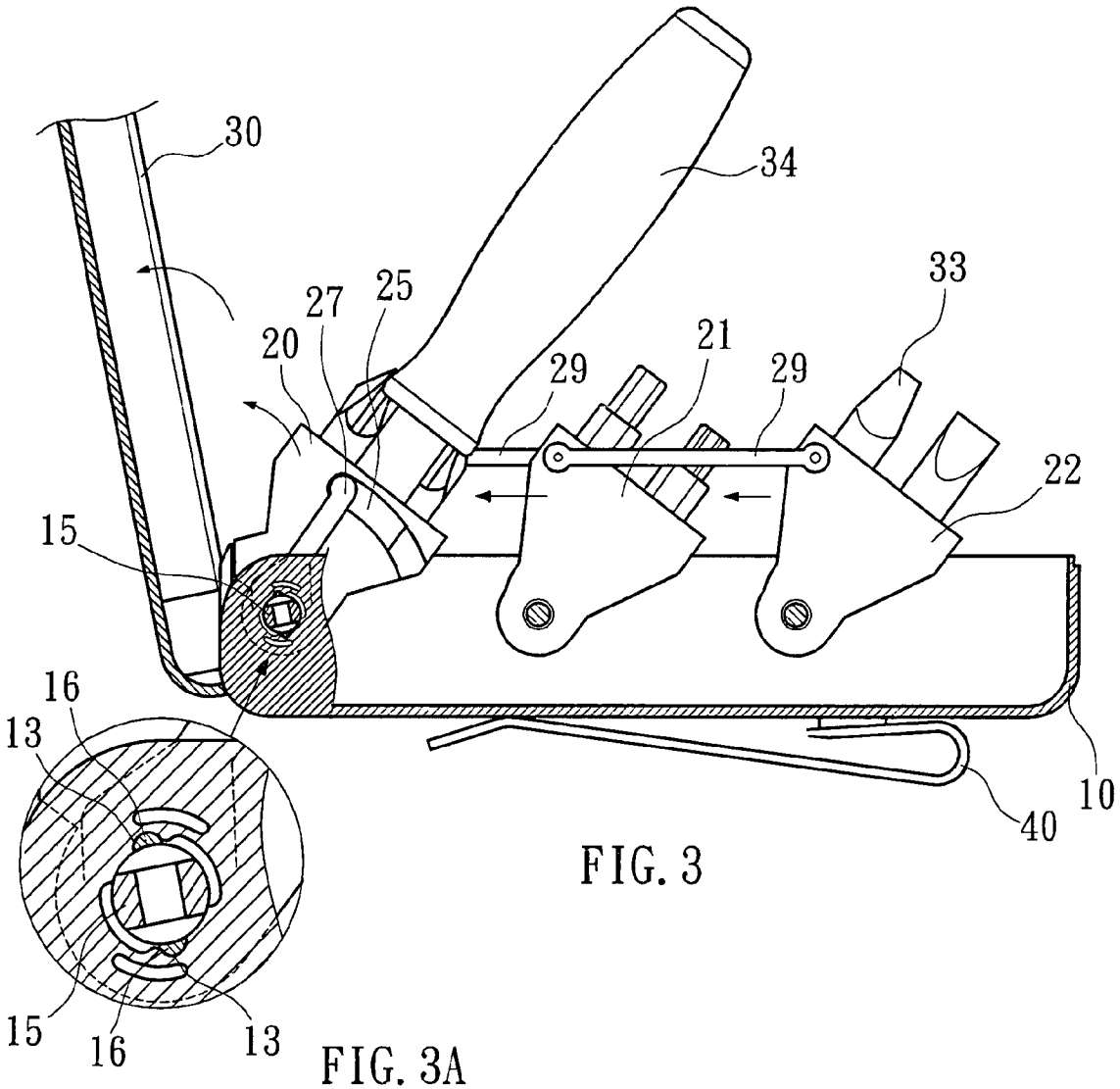
FIG. 3 is a schematic sectional side view of the present invention, showing the toolbox opened.
FIG. 3A is an enlarged view of a part of FIG. 3.
Figures 4, 4A:
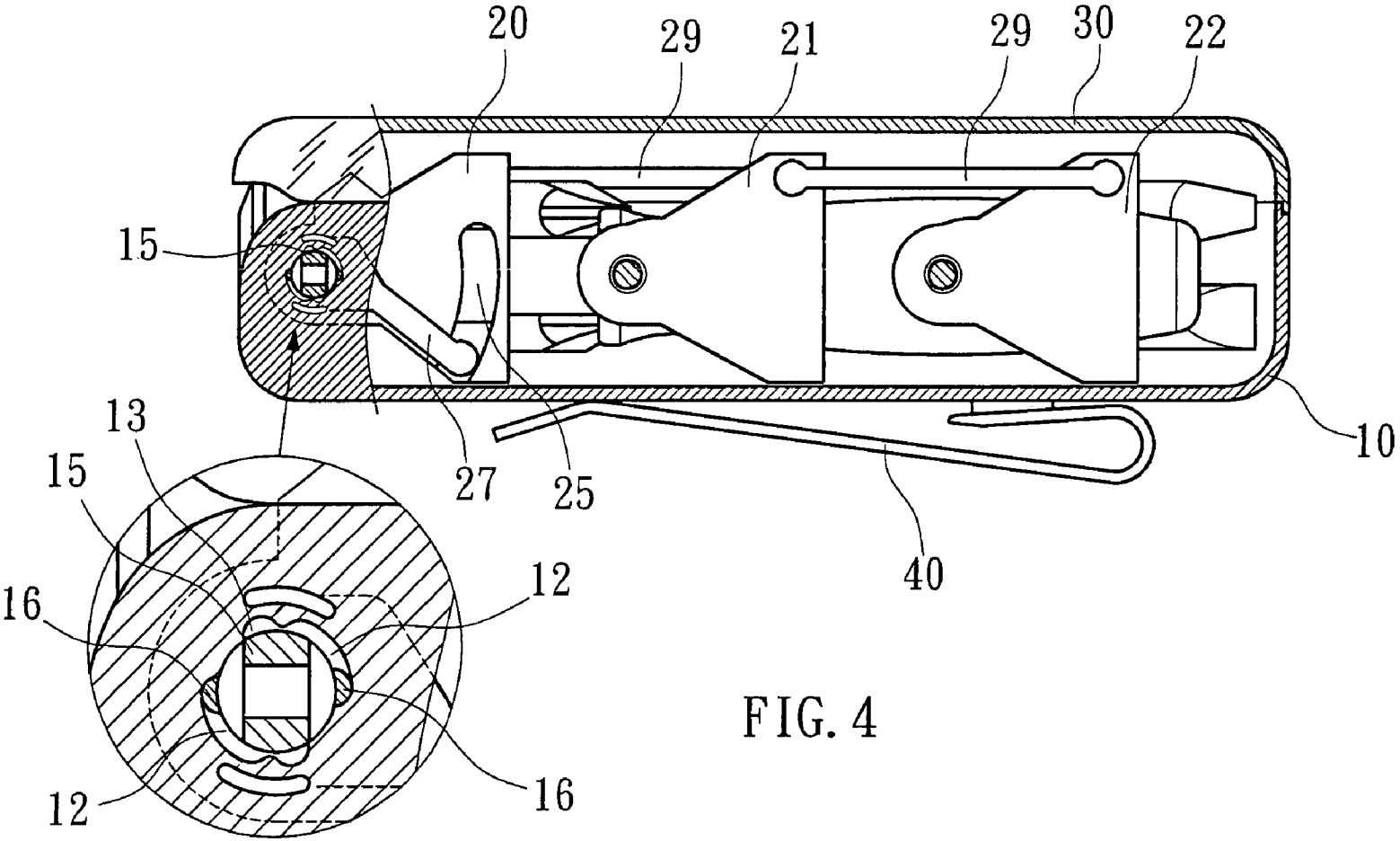
FIG. 4 is a schematic sectional side view of the present invention, showing the toolbox closed.
FIG. 4A is an enlarged view of a part of FIG. 4.

Referring to FIGS. 2~4 again, when opened the top cover 30 from the box body 10, the tool holders 20~22 are turned out of the box body 10 for allowing tool members (for example, a tool handle and a set of tool bits) 33, 34 to be mounted in the plugholes 23 (see FIGS. 2 and 3), and the locating ribs 16 of the pivot bolts 15 are respectively engaged into the second locating notches 13 to hold the top cover 30 in the open position. When closed the top cover 30 as shown in FIG. 4, the pivot bolts 15 are forced by the lugs 31 of the top cover 30 to rotate in one direction, thereby causing the actuating arm 27 to be turned with the pivot bolts 15, and therefore the first tool holder 20 is released from the upward supporting pressure of the actuating arm 27 and forced downwards by the gravity weight thereof to the inside of the box body 10. Because the tool holders 20~22 are linked to one another by the links 29, the other tool holders 21, 22 are turned downwards with the first tool holder 20 into the inside of the box body 10, and the locating ribs 16 of the pivot bolts 15 are respectively engaged into the first locating notches 12 to hold the top cover 30 in the close position.

Figure 5A:
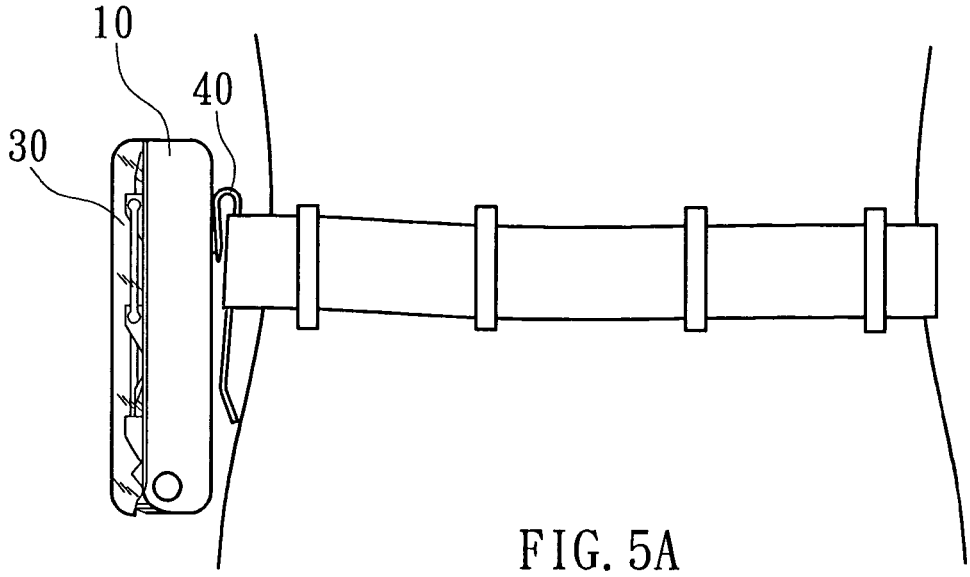
FIG. 5A is a schematic drawing showing the toolbox fastened to the user's belt.
Figure 5B:
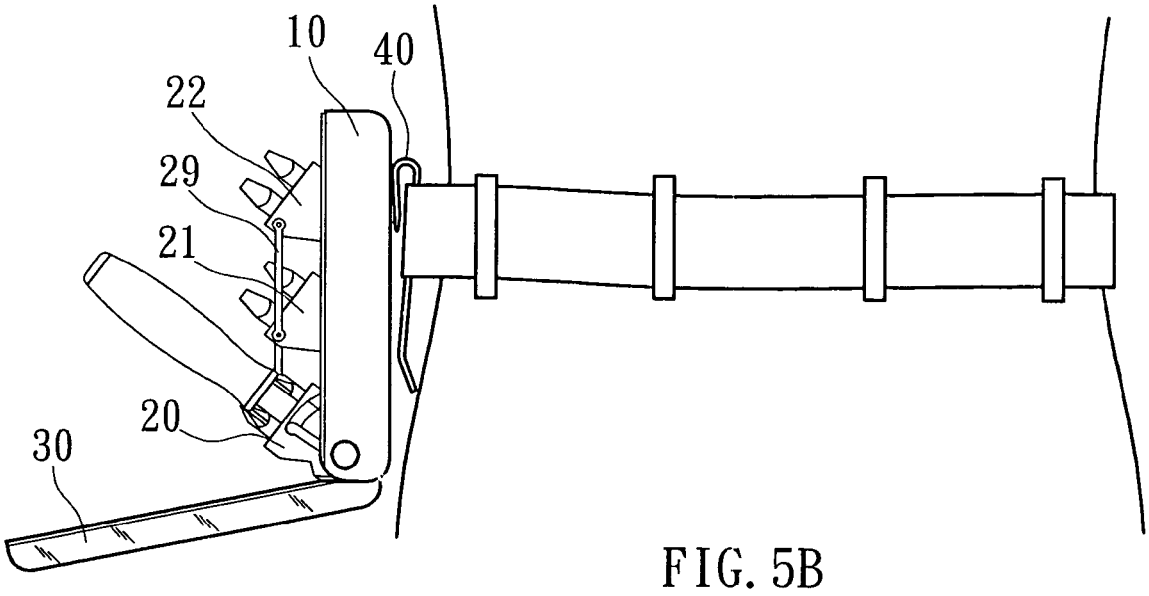
FIG. 5B is similar to FIG. 5A but showing the toolbox opened.

Referring to FIGS. 5A and 5B, by means of the clip 40, the toolbox can be fastened to the user's belt so that the user can pivot up the storage tool members conveniently during working.

A prototype of toolbox has been constructed with the features of FIGS. 1~5. The toolbox functions smoothly to provide all the features discussed earlier.

Although a particular embodiment of the invention had been described in detail for purposes of illustration, various modifications and enhancements may be made without departing from the spirit and scope of the invention. Accordingly, the invention is not to be limited except as by the appended claims.

What the invention claimed is:

1. A toolbox comprising:

a box body, said box body comprising two pivot holes formed in the two opposite sidewalls thereof near one end, a plurality of first locating notches and second locating notches respectively formed in the two opposite sidewalls in communication with the pivot holes, and a plurality of pivot holders symmetrically disposed at the two opposite sidewalls at an inner side inside said box body;

a top cover coupled to said box body and turnable relative to said box body between an open position and a close position, said top cover comprising two lugs symmetrically disposed at two opposite lateral sides near one end thereof, said lugs each having a sliding slot;

two pivot bolts for fastening said top cover to said box body and for supporting said top cover between said open position and said close position, each said pivot bolt having at least one peripheral rib for selectively engaging into the at least one first locating notch and at least one second locating notch of said box body to respectively support said top cover in one of said open position and said close position;

a plurality of tool holders respectively mounted in said box body and able to turn in and out of said box body upon turning of said top cover between said open position and said close position, said tool holders including a first tool holder and a plurality of second tool holders, said tool holders each having a plurality of plugholes for holding tool members, said first tool holder comprising two pivot holes respectively disposed at two opposite lateral sides thereof near a front side thereof and respectively pivotally connected to the pivot holes of said box body and the sliding slots of the lugs of said top cover by said pivot bolts and a smoothly arched sliding slot at one of the two lateral sides, said second tool holders each having two pivot rods symmetrically disposed at two sides of each second tool holder and respectively pivotally connected to the pivot holders of said box body;

an actuating arm, said actuating arm having a first end, a sliding slot formed in said first end and coupled to one said pivot bolt between one sidewall of said box body and one lateral side of said first tool holder, and an angled second end coupled to the smoothly arched sliding slot of said first tool holder to turn said first tool holder out of said box body upon turning of said top cover from said close position to said open position and for enabling said first tool holder to be forced by the gravity weight thereof into the inside of said box body upon turning of said top cover from said open position to said close position; and a plurality of links alternatively disposed at two sides and respectively connected between each two adjacent tool holders to link said tool holders for enabling said tool holders to be turned in and out of said box body upon turning of said top cover between said close position and said open position.

* * * * *